US009890671B2

(12) United States Patent
Parikh et al.

(10) Patent No.: US 9,890,671 B2
(45) Date of Patent: Feb. 13, 2018

(54) CRANKCASE VENTILATION SYSTEM HAVING AN OIL JET PUMP WITH AN INTEGRATED CHECK VALVE

(71) Applicant: Cummins Filtration IP, Inc., Columbus, IN (US)

(72) Inventors: Chirag D. Parikh, Madison, WI (US); Brian W. Schwandt, Fort Atkinson, WI (US); Arun P. Janakiraman, Stoughton, WI (US); Ashwin K. Koleshwar, Stoughton, WI (US)

(73) Assignee: CUMMINS FILTRATION IP, INC., Columbus, IN (US)

( * ) Notice: Subject to any disclaimer, the term of this patent is extended or adjusted under 35 U.S.C. 154(b) by 87 days.

(21) Appl. No.: 15/036,729

(22) PCT Filed: Nov. 17, 2014

(86) PCT No.: PCT/US2014/065901

§ 371 (c)(1),
(2) Date: May 13, 2016

(87) PCT Pub. No.: WO2015/073946

PCT Pub. Date: May 21, 2015

(65) Prior Publication Data

US 2016/0290194 A1 Oct. 6, 2016

Related U.S. Application Data

(60) Provisional application No. 61/962,875, filed on Nov. 18, 2013.

(51) Int. Cl.
*F01M 13/04* (2006.01)
*F01M 1/16* (2006.01)
(Continued)

(52) U.S. Cl.
CPC ..... *F01M 13/04* (2013.01); *F01M 1/16* (2013.01); *F01M 13/028* (2013.01);
(Continued)

(58) Field of Classification Search
CPC ..... F01M 13/04; F01M 13/00; F01M 2013/0038; F01M 2013/0044;
(Continued)

(56) References Cited

U.S. PATENT DOCUMENTS

2002/0088445 A1 7/2002 Weindorf et al.
2003/0000508 A1 1/2003 Takahashi et al.
(Continued)

FOREIGN PATENT DOCUMENTS

CN 202937330 U 5/2012
KR 20020019268 3/2002
KR 20020019268 A * 3/2002

OTHER PUBLICATIONS

International Search Report and Written Opinion for PCT/US2014/065901, dated Feb. 19, 2015, 7 pages.

*Primary Examiner* — Jacob Amick
(74) *Attorney, Agent, or Firm* — Foley & Lardner LLP

(57) ABSTRACT

A crankcase ventilation system having a crankcase ventilation filter and a filter drain. The crankcase ventilation filter vents blow-by gases from a crankcase and separates oil from the blow-by gases. The crankcase ventilation filter drain collects oil separated by the crankcase ventilation filter and returns the separated oil to the crankcase or another component of the engine. A nozzle is coupled to a pressurized oil supply and directs an oil jet into a mixing bore of the system, which draws the oil back into recirculation. A valve is coupled to the filter drain and is configured to prevent collected oil from reentering the crankcase ventilation filter through an opening that connects the filter drain to the filter.

24 Claims, 8 Drawing Sheets

(51) Int. Cl.
*F01M 13/02* (2006.01)
*F01M 13/00* (2006.01)

(52) U.S. Cl.
CPC ..... *F01M 2013/0044* (2013.01); *F01M 2013/0438* (2013.01); *F01M 2013/0494* (2013.01)

(58) Field of Classification Search
CPC ..... F01M 2013/005; F01M 2013/0077; F01M 13/02; F01M 13/021; F01M 13/022; F01M 2013/026; F01M 2013/0438; F01M 13/028; F01M 2013/0494
See application file for complete search history.

(56) References Cited

U.S. PATENT DOCUMENTS

2009/0025662 A1* 1/2009 Herman ..... F01M 13/04 123/41.86
2010/0175642 A1* 7/2010 Herman ..... F01M 13/04 123/41.86

* cited by examiner

CRANKCASE VENTILATION SYSTEM HAVING AN OIL JET PUMP WITH AN INTEGRATED CHECK VALVE

CROSS-REFERENCE TO RELATED APPLICATIONS

This application is a U.S. national stage application claiming the benefit of International Application No. PCT/US2014/065901, filed on Nov. 17, 2014, which claims priority to U.S. Provisional Patent Application No. 61/962,875, entitled "CRANKCASE VENTILATION SYSTEM HAVING AN OIL JET PUMP WITH AN INTEGRATED CHECK VALVE," filed on Nov. 18, 2013. The entire contents of these applications are incorporated herein by reference in their entirety and for all purposes.

TECHNICAL FIELD

This present application relates to crankcase ventilation ("CV") systems for internal combustion engines. More particularly, the present application relates to a jet pump having an integrated check valve that prevents the flow of engine oil into a crankcase ventilation filter of the CV system under cold engine operating conditions.

BACKGROUND

During the combustion cycle of conventional internal combustion engines, some combustion gases may leak past the piston rings of the cylinder and into the crankcase. These leaked gases are often referred to as blow-by gases. Crankcase ventilation ("CV") systems are employed to vent the blow-by gases from the crankcase. Some CV systems are open loop systems, meaning the blow-by gases are vented to the ambient environment. Other CV systems are closed loop systems, meaning the blow-by gases are returned to the engine for combustion.

Many CV systems include a crankcase ventilation filter that allows the blow-by gases to be swept out of the crankcase (e.g., out of a road draft tube, into the engine intake, etc.). The crankcase ventilation filter may be a coalescing filter, a ventilation rotating filter, a coalescer, an inertial separator or the like. The crankcase ventilation filter may assist in treating the blow-by gases to reduce environmental impact of the internal combustion engine. In some situations, oil contained in the crankcase may backtrack into the crankcase ventilation filter. Backtracked oil may damage the CV system and/or the engine if it enters and remains in the crankcase ventilation filter. Accordingly, the crankcase ventilation filter may include a drain chamber to route any backtracked oil back to the engine or crankcase. However, in some engines, oil contained in the crankcase is at a higher pressure than the oil in the crankcase ventilation filter drain. Thus, the oil in the crankcase ventilation filter drain may need to be pumped back into the engine or crankcase to overcome the pressure differential.

Some CV systems utilize an oil jet pump to help drain separated oil in the drain chamber of the crankcase ventilation filter back to the crankcase. Pressurized oil is forced through a nozzle, which creates a high-velocity stream of engine oil that is directed towards a mixing bore of the oil driven jet-pump in the CV system. The mixing bore is arranged adjacent to the crankcase ventilation filter drain along a conduit routing oil back to the engine or crankcase. The high-velocity stream of oil leaving the nozzle and entering the mixing bore creates shear forces on the oil in the drain chamber. The shear forces draw the oil from the crankcase ventilation filter drain into the conduit routing oil back to the engine or crankcase thereby creating a pumping effect.

However, under cold engine conditions, the oil may be too viscous to form the required high-velocity stream that creates the necessary shear forces to draw oil from the crankcase ventilation filter drain to the conduit routing the oil back to the engine or crankcase. The high viscosity may be the result of the oil's low temperature caused by a cold engine condition. Additionally, under cold engine conditions, the pressurized oil may flow into the crankcase ventilation filter drain and potentially damage the crankcase ventilation filter and or cause oil loss due to increased oil consumption.

SUMMARY

One embodiment relates to a crankcase ventilation system including a crankcase ventilation filter configured to vent blow-by gases from a crankcase. A crankcase ventilation filter drain is coupled to the crankcase ventilation filter, wherein the crankcase ventilation filter drain is configured to collect oil that enters the crankcase ventilation filter and to return the collected oil to the crankcase. The system includes a pressurized oil supply, as well as a nozzle coupled to the pressurized oil supply and configured to form an oil jet adjacent to an exit of the crankcase ventilation filter drain. A valve is coupled to the crankcase ventilation filter drain, wherein the valve is configured to prevent pressurized oil supply back-tracking and entering the crankcase ventilation filter through an opening that connects the crankcase ventilation filter drain to the crankcase ventilation filter housing. When a temperature of the pressurized oil is above a threshold temperature, the oil jet draws the collected oil out of the filter drain to the exit back into the crankcase. When the temperature of the pressurized oil is below the threshold temperature, the oil jet does not draw the collected oil out of the crankcase ventilation filter drain and oil from the pressurized oil supply backtracks into the crankcase ventilation filter drain.

Another embodiment relates to a lubrication system for an internal combustion engine having a crankcase. The lubrication system includes a crankcase ventilation filter drain configured to provide oil separated from crankcase blow-by gases. The separated oil is at a lower pressure than oil in the internal combustion engine. A mixing bore is in fluid communication with the crankcase ventilation filter drain and a pressurized oil supply. A nozzle is in fluid communication with the pressurized oil supply. The nozzle directs a pressurized flow of oil into the mixing bore such that the pressurized flow of oil draws the separated oil from the crankcase ventilation filter drain into a component of the internal combustion engine. A valve is coupled to the crankcase ventilation filter drain. The valve is configured to prevent the separated oil from flowing back into the crankcase.

These and other features, together with the organization and manner of operation thereof, will become apparent from the following detailed description when taken in conjunction with the accompanying drawings.

DETAILED DESCRIPTION OF VARIOUS EMBODIMENTS

Referring to the figures generally, the various embodiments disclosed herein relate to a crankcase ventilation ("CV") system having a check valve in combination with a pump (e.g., an oil jet pump). The check valve allows for temporary choking or restricting the backflow of engine oil into the CV system crankcase ventilation filter from the engine under cold operating conditions. When the check valve is closed (i.e., choking the backflow of oil into the crankcase ventilation filter), the crankcase ventilation filter's continuous drainage functionality may be reduced. After the engine oil warms up to a threshold temperature, the engine oil becomes thin enough to form a high-velocity stream (e.g., less viscous than at a lower temperature) as the oil passes through a nozzle of the CV system. The high-velocity stream creates necessary shear forces to draw engine oil out of the crankcase ventilation filter and back into the crankcase or the engine. Once the necessary shear forces are created, the check valve opens to allow for normal crankcase ventilation filter drain operation.

Figure 1:
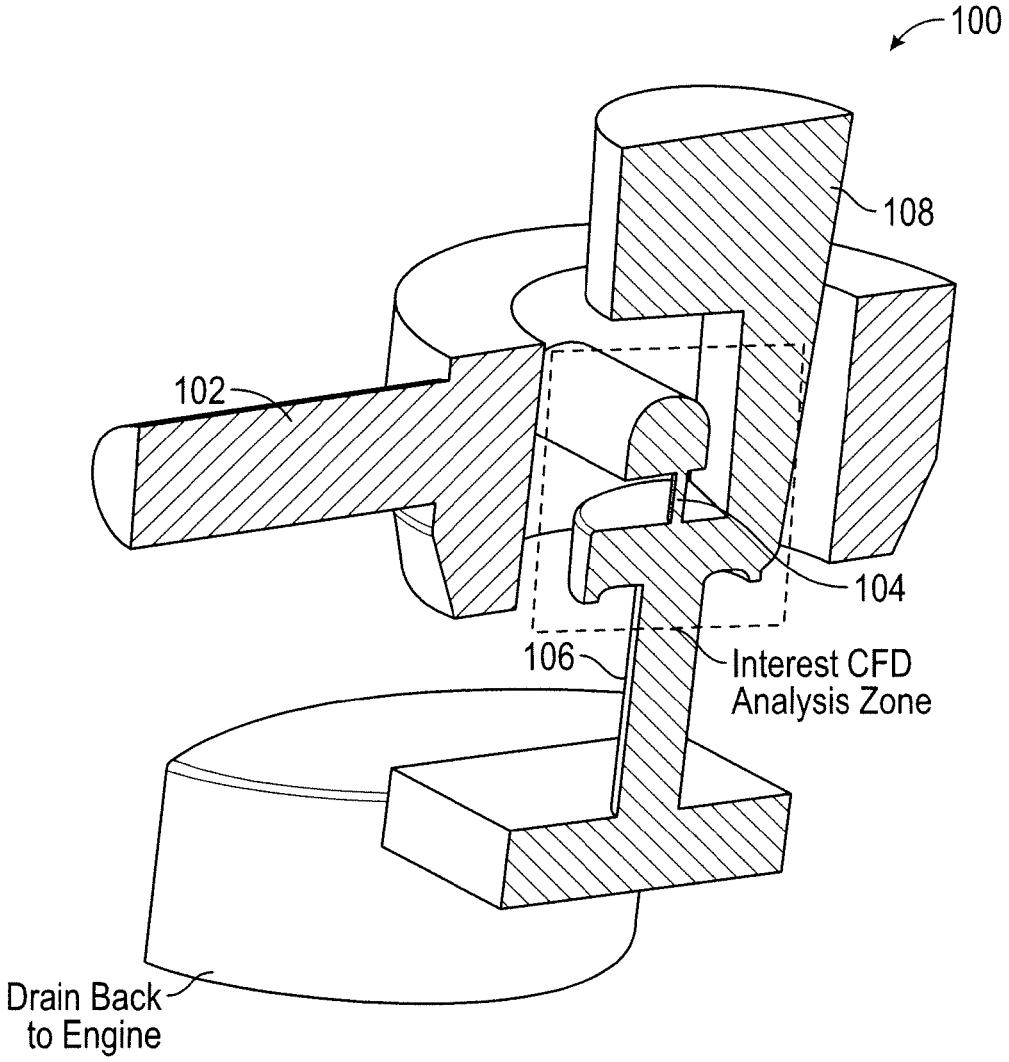
FIG. 1 is a cross-sectional view of a portion of CV system for a lubrication system of an internal combustion engine is shown according to an exemplary embodiment.

Referring to FIG. 1, a cross-sectional view of a portion of CV system 100 for a lubrication system of an internal combustion engine is shown according to an exemplary embodiment. The lubrication system circulates engine lubrication oil (e.g., 15W40 motor oil), shown as pressurized oil 102, to the various components of the internal combustion engine. The oil 102 may be circulated through the engine by a pump. As shown in FIG. 1, the CV system 100 includes a supply of pressurized oil 102 that flows through a nozzle 104. The nozzle 104 may create a high-velocity stream of engine oil that is directed towards a mixing bore 106 of the CV system 100. After leaving the nozzle 104, the oil 102 then enters a mixing bore 106. In some arrangements, the diameter of the mixing bore 106 can range between 1.2 to 3 times the diameter of the nozzle 104. After passing through the mixing bore 106, the oil is routed back to the components of the engine (e.g., back to the crankcase). The velocity of the stream is at least partially dependent on the viscosity of the oil 102. Accordingly, as the temperature of the oil 102 increases (e.g., from engine operation), the oil 102 becomes less viscous and the velocity of stream exiting the nozzle 104 increases. The nozzle 104 may be a motive jet nozzle.

During operation of the internal combustion engine, some combustion blow-by gases may leak past the piston rings of the cylinder and into the crankcase of the engine. The blow-by gases may be removed from the crankcase through the CV system 100. The CV system 100 includes a crankcase ventilation filter (inertial separator, static and dynamic coalescing CV filters, etc.). The crankcase ventilation filter may be coalescing filter, a ventilation rotating filter, a coalescer, an inertial separator, or the like. The crankcase ventilation filter is configured to vent blow-by gases from the crankcase. In some situations, oil contained in the crankcase may backtrack into the crankcase ventilation filter and or the CV housing. Accordingly, the crankcase ventilation filter includes a crankcase ventilation filter drain 108 to provide the backtracked oil back to the engine or the crankcase. The oil in the crankcase ventilation filter drain 108 may be a first pressure and the oil in the crankcase or the engine may be at a second pressure, wherein the first pressure is lower than the second pressure. Accordingly, the oil contained in the crankcase ventilation filter drain 108 will not naturally flow back into the engine or crankcase (e.g., via gravity). The oil contained in the crankcase ventilation filter drain 108 may be drawn or pumped across the pressure differential and back into the engine or crankcase.

Referring again to FIG. 1, the crankcase ventilation filter drain 108 configured to collect backtracked oil and to drain the collected oil downstream of the nozzle 104 (i.e., after the nozzle 104 in a flow direction of the oil leaving the nozzle 104). The crankcase ventilation filter drain 108 may provide the collected oil to the mixing bore of the lubrication system. The diameter of the crankcase ventilation filter drain 108 may be at least three times the diameter of the nozzle 104. The outlet or exit of the crankcase ventilation filter drain 108 may be adjacent to the nozzle 104. Accordingly, when a high-velocity stream of lubrication oil is exiting the nozzle 104 towards a mixing bore 106, the high-velocity stream of lubrication oil creates shear forces on the oil collected in the crankcase ventilation filter drain 108. The shear forces draw the collected oil from the crankcase ventilation filter drain 108 into the mixing bore 106 and back to the engine or the crankcase.

Figure 2:
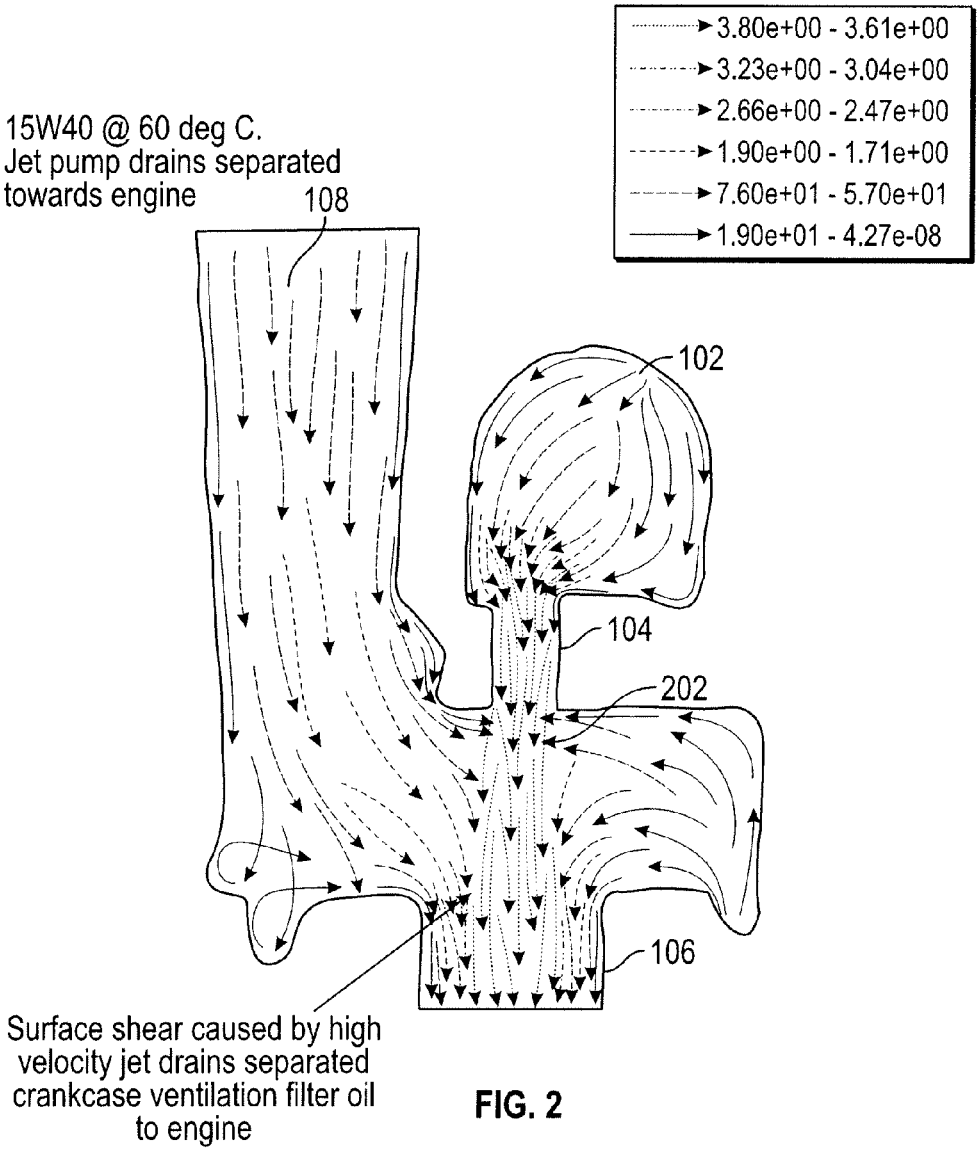
FIG. 2 is a cross-sectional view showing lubrication oil flowing at a first velocity through a nozzle of the portion of the CV system of FIG. 1.

Referring to FIG. 2, a first cross-sectional view showing lubrication oil flowing through the portion of the CV system 100 of FIG. 1 is shown. As shown in FIG. 2, a high-velocity stream 202 of lubrication oil that is formed by the nozzle 104 and is directed towards the mixing bore 106. The oil flowing through the nozzle 104 is thin enough to form a high-velocity stream 202. For example, the oil may be 15W40 oil at sixty degrees Celsius. The high-velocity stream 202 of oil from the nozzle 104 and through the mixing bore 106 creates shear forces on the oil contained in the crankcase ventilation filter drain 108. The shear forces on the oil contained in the crankcase ventilation filter drain 108 draw the oil contained in the crankcase ventilation filter drain 108 from the crankcase ventilation filter drain 108 and into the mixing bore 106. In effect, the high-velocity stream 202 pumps the oil contained in the crankcase ventilation filter drain 108 from the low pressure within the crankcase ventilation filter drain 108 to a high pressure within the crankcase. The flow of oil from the crankcase ventilation filter drain 108 to the mixing bore 106 may be referred to as a scavenge flow.

Figure 3:
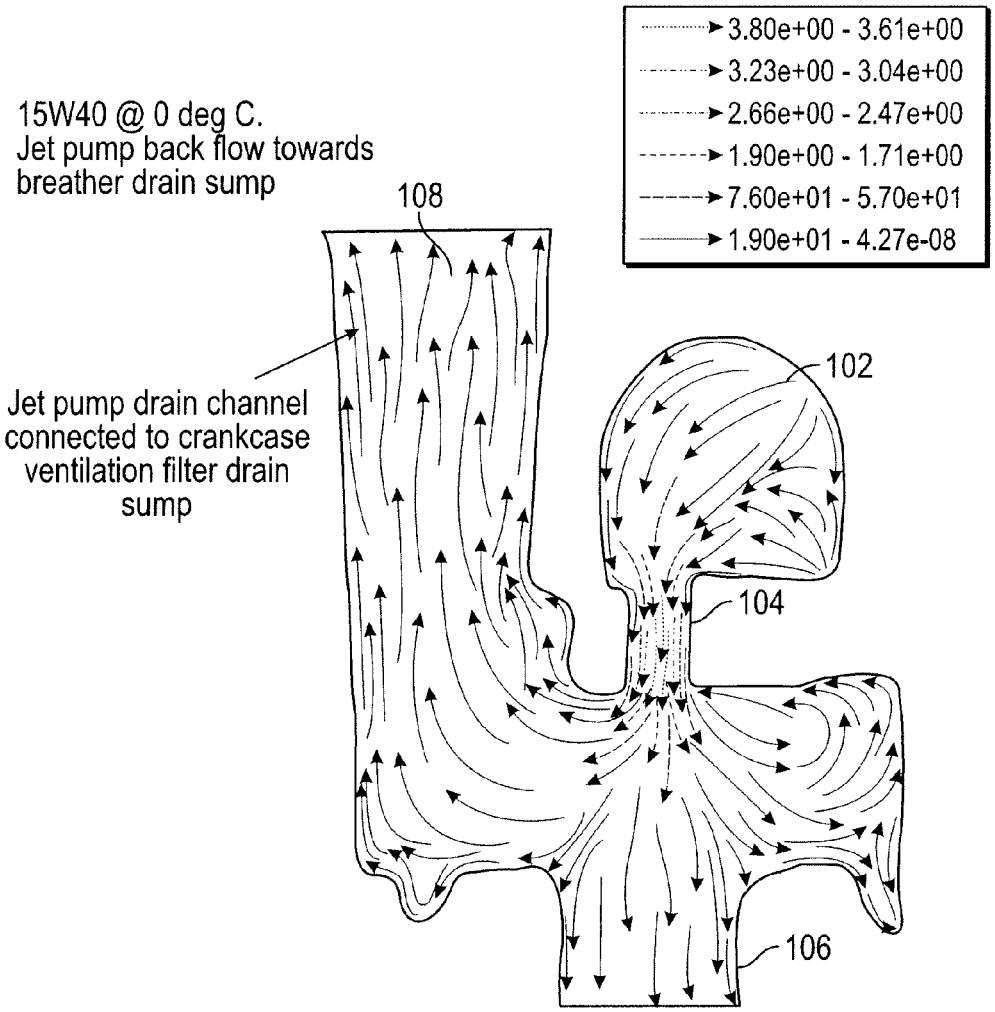
FIG. 3 is a cross-sectional view showing lubrication oil flowing at a second velocity through the nozzle of the portion of the CV system of FIG. 1.

Referring to FIG. 3, a second cross-sectional view showing lubrication oil flowing through the portion of the CV system 100 of FIG. 1 is shown. The oil flow of FIG. 3 is exemplary of a backflow condition in which oil flows up the crankcase ventilation filter drain 108 and away from the mixing bore 106. The oil flowing through the nozzle 104 is more viscous than the oil flowing through the nozzle 104 in FIG. 2. This may be caused by cold engine conditions (e.g., when an engine first starts up, cold weather, etc.). For example, the oil may be 15W40 oil at zero degrees Celsius.

Since the oil is more viscous than the oil in FIG. 2, the oil does not form a high-velocity stream (as shown in FIG. 2) when passing through the nozzle 104. When the high-velocity stream is not formed, the shear forces created on the oil contained in the crankcase ventilation filter drain 108 are not great enough to draw the collected oil from the crankcase ventilation filter drain 108 into the mixing bore 106. As shown by the flow arrows, the oil leaving the nozzle 104 may flow from the higher pressure of the mixing bore 106 to the lower pressure of the crankcase ventilation filter drain 108.

Figure 4:
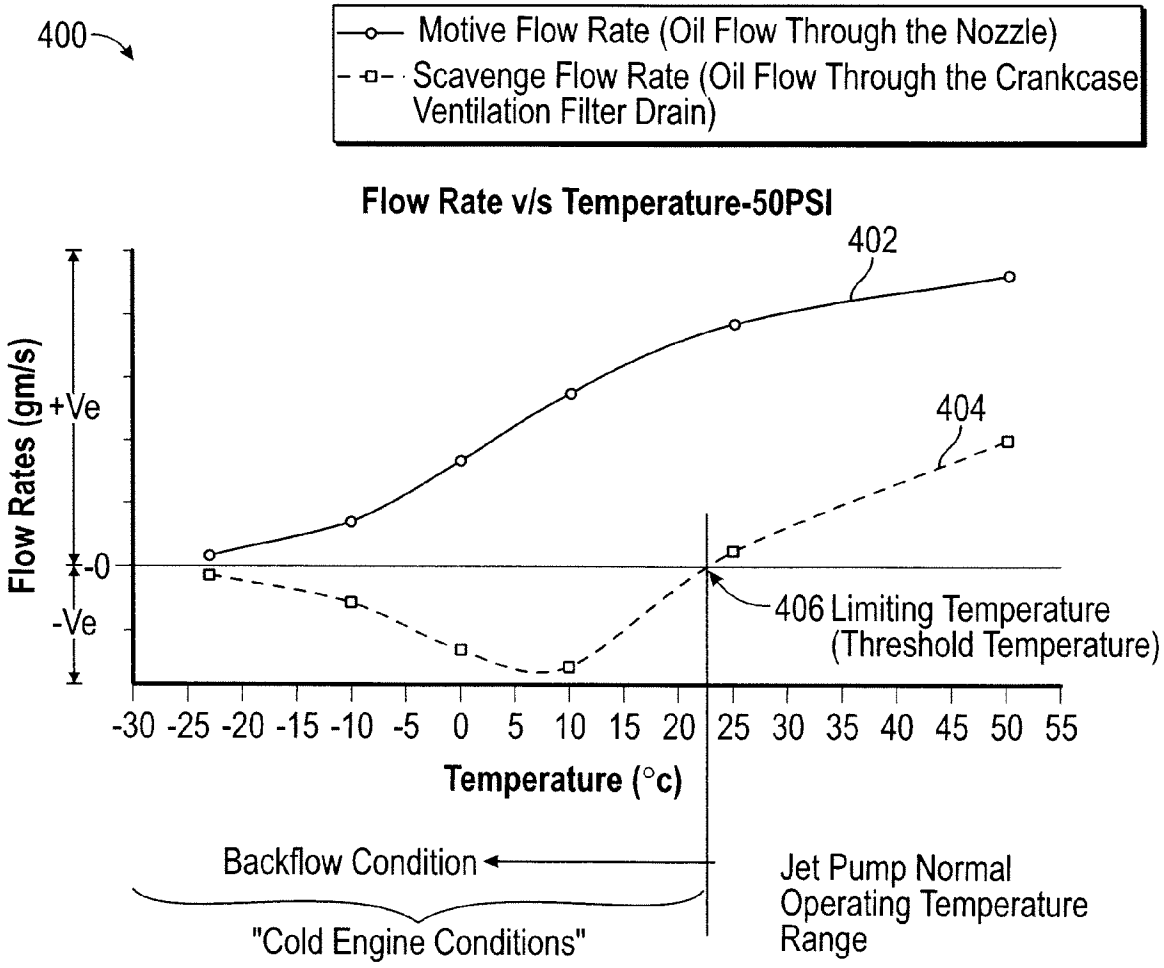
FIG. 4 is a graph of oil flow rate of the CV system of FIG. 1 versus temperature.

Referring to FIG. 4, a graph 400 of oil flow rate of the CV system of FIG. 1 versus temperature is shown. The graph charts both the oil flow rate through the nozzle 104 ("motive" flow rate 402) and the oil flow rate through the crankcase ventilation filter drain 108 ("scavenge" flow rate 404). As shown in the graph, as temperature of the oil increases, the motive flow rate 402 generally increases. The motive flow rate 402 increases because the oil becomes less viscous as the oil temperature increases. Under cold engine conditions, the scavenge flow rate 404 is negative, meaning that the oil flows into and through the crankcase ventilation filter drain 108 and away from the mixing bore 106 (e.g., as shown in FIG. 3). As the temperature of the oil crosses the threshold temperature 406, the scavenge flow rate 404 becomes positive, meaning that the oil flows through the crankcase ventilation filter drain 108 and into the mixing bore 106 (e.g., as shown in FIG. 2).

Figure 5:
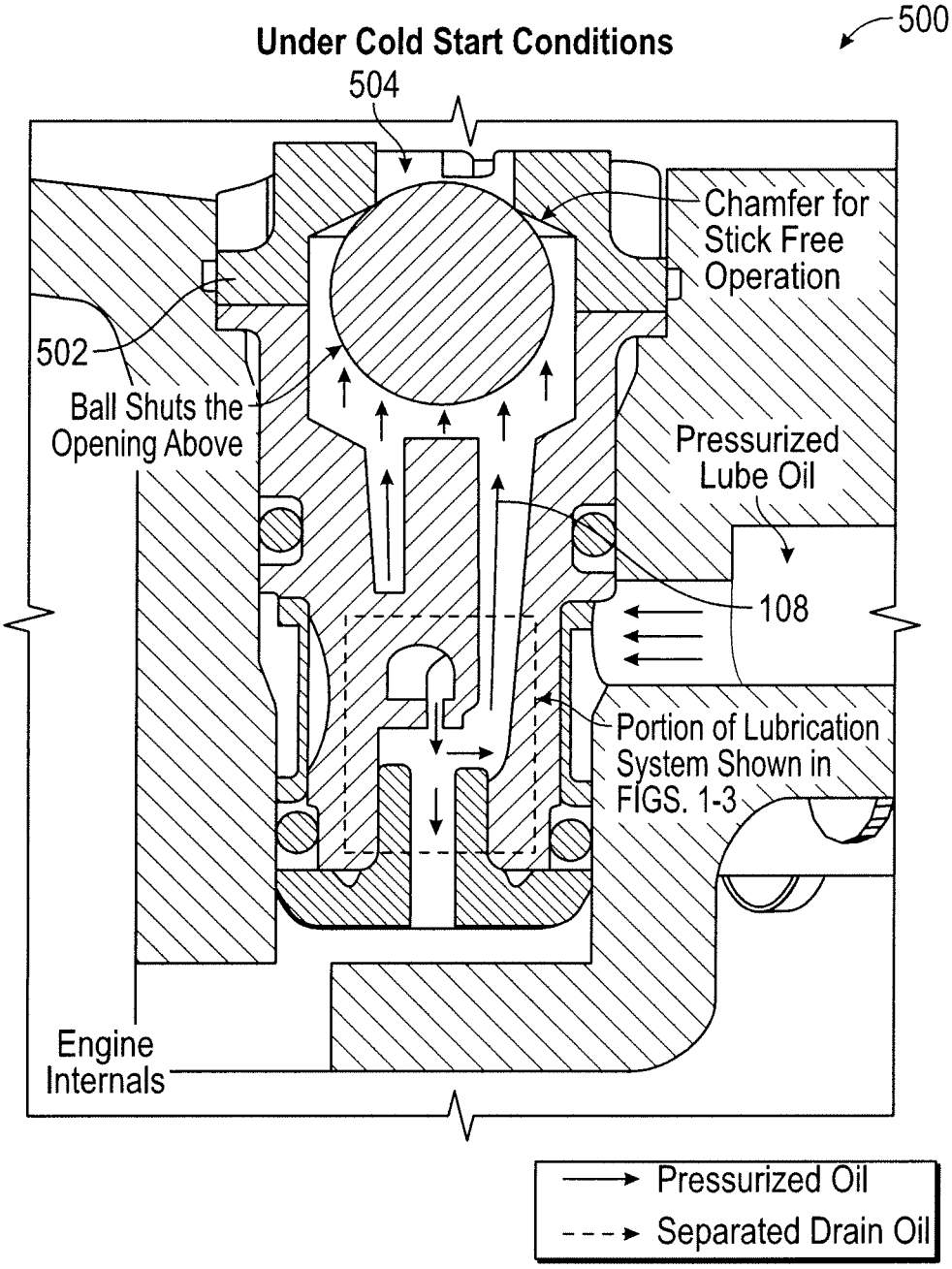
FIG. 5 is a cross-sectional view of a check valve of the CV system in a closed position is shown according to an exemplary embodiment.

Referring to FIG. 5, a cross-sectional view of a check valve 500 of the CV system is shown according to an exemplary embodiment. The check valve 500 of FIG. 5 is shown in the closed position, meaning the valve prevents the flow of oil out of an opening 504 in the crankcase ventilation filter drain 108 (e.g., an opening in the valve cap) and into the crankcase ventilation filter 502. A protective screen or filter (not shown) may be placed over the opening 504. As noted above with respect to FIG. 3, during cold engine conditions, the oil pressure differential forces oil up through the crankcase ventilation filter drain 108 and away from the mixing bore 106. If the backflow of oil completely fills the crankcase ventilation filter drain 108 and/or the crankcase ventilation filter 502, sludge may be deposited in the crankcase ventilation filter 502. The sludge may damage the crankcase ventilation filter 502, which may in turn damage the engine. Accordingly, the check valve 500 closes when the oil flows into the crankcase ventilation filter drain 108, thereby choking the flow of oil through the crankcase ventilation filter drain 108 and preventing the flow of oil into the crankcase ventilation filter 502.

The check valve 500 is closed when the ball 506 is pressed against the opening 504. The ball 506 is comprised of a material that is of a lower density than the oil. The ball 506 may be hollow or solid. The ball 506 is of a larger diameter than the opening 504 of the crankcase ventilation filter drain 108. Accordingly, as the oil flows into the crankcase ventilation filter drain 108, the oil lifts the ball 506 into place against the opening to the crankcase ventilation filter drain 108. The opening 504 and the ball 506 have mating shapes such that when the ball 506 is pressed against the opening 504 by the backflow of oil, the backflow of oil is prevented from exiting the crankcase ventilation filter drain 108 through the opening 504. The opening 504 may be chamfered or domed to prevent the ball 506 from sticking in the opening 504 and increased operational angularity capabilities.

Figure 6:
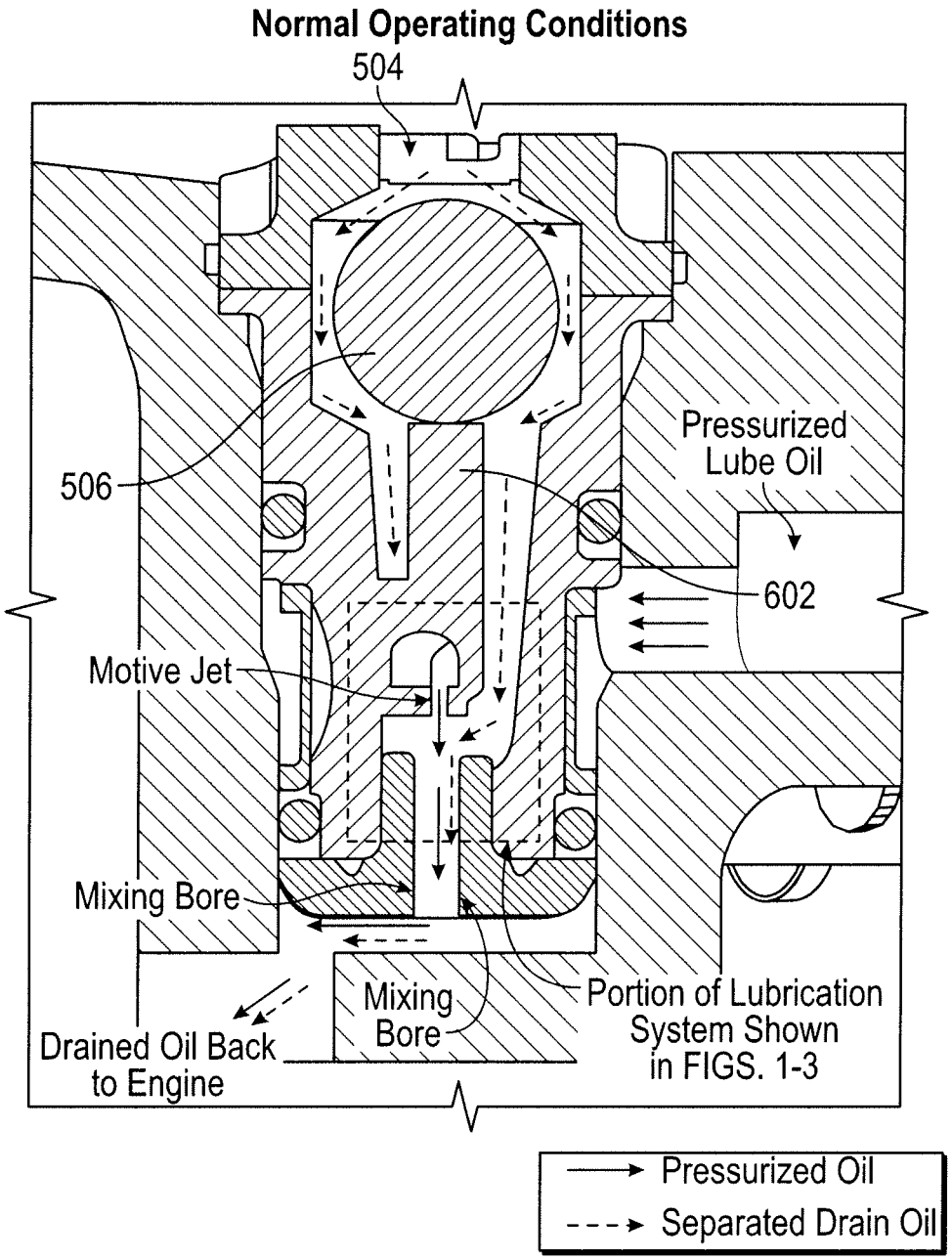
FIG. 6 is a cross-sectional view of the check valve of FIG. 5 in an open position.

Referring to FIG. 6, a cross-sectional view of the check valve 500 of FIG. 5 in an open position. As the engine begins to warm and as the oil heats up, the oil's viscosity reduces (e.g., as shown above in FIG. 4). As the oil's viscosity reduces, a high-velocity jet of oil flowing through the nozzle 104 forms, and the shear forces on the oil in the crankcase ventilation filter drain 108 begin to draw the oil out of the crankcase ventilation filter drain 108. As the oil leaves the crankcase ventilation filter drain 108, the ball 506 floats away from the opening 504 in the crankcase ventilation filter drain 108 (i.e., gravity pulls the ball 506 down away from the opening). In some arrangements the ambient air pressure on the other side of the opening may force the ball 506 away from the opening 504. When the oil level within the crankcase ventilation filter drain 108 falls below a threshold, the ball 506 rests on standoffs 602 in a non-floating position. The standoffs 602 may be supports, ribs, machined pockets, cavities, or the like. The standoffs 602 prevent choking off of the backflow oil out of the crankcase ventilation filter drain 108.

Although the check valve 500 of FIG. 5 and FIG. 6 utilizes a ball 506, alternative arrangements of the check valve may utilize a disc or a flap. In such an arrangement, the disc or flap functions with the same basic principles of the ball 506. The disc or flap prevents the backflow of oil through the crankcase ventilation filter drain 108 and into the crankcase ventilation filter 502 by blocking the opening 504 when the scavenge flow rate is negative. The disc or flap allows the oil in the crankcase ventilation filter drain 108 to leave the crankcase ventilation filter drain 108 when the scavenge flow rate is positive. The disc or flap may or may not be comprised of a material having a lower density than the oil used by the internal combustion engine. Guides may be formed in the crankcase ventilation filter drain to prevent the disc or flap from sticking in the closed position.

Figure 7:
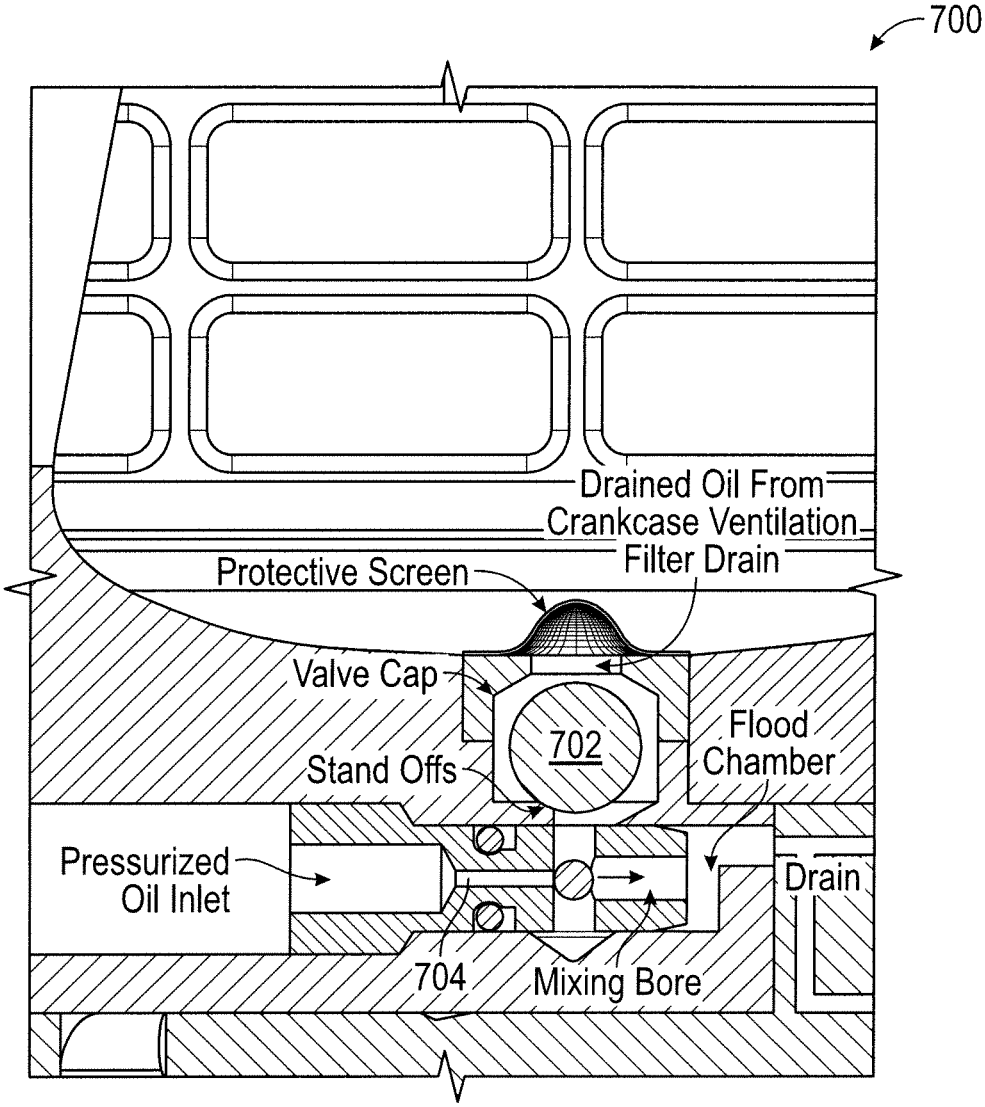
FIG. 7 is a cross-sectional view of a CV system for a lubrication system of an internal combustion engine according to an exemplary embodiment.

Referring to FIG. 7, a check valve and oil pump combination 700 is shown according to an alternative embodiment. Unlike the check valve and oil pump combination discussed above with respect to FIGS. 1-6, the pump (i.e., the high-velocity stream of oil) is arranged in a horizontal fashion as opposed to a vertical fashion. Accordingly, the ball 702 (or disc or flapper) moves in a direction that is perpendicular to the high-velocity jet of oil generated by the nozzle 704. The general operation of the check valve and oil pump combination 700 of FIG. 7 is substantially the same as the general operation of the check valve and oil pump combination of FIGS. 1-6.

Figure 8:
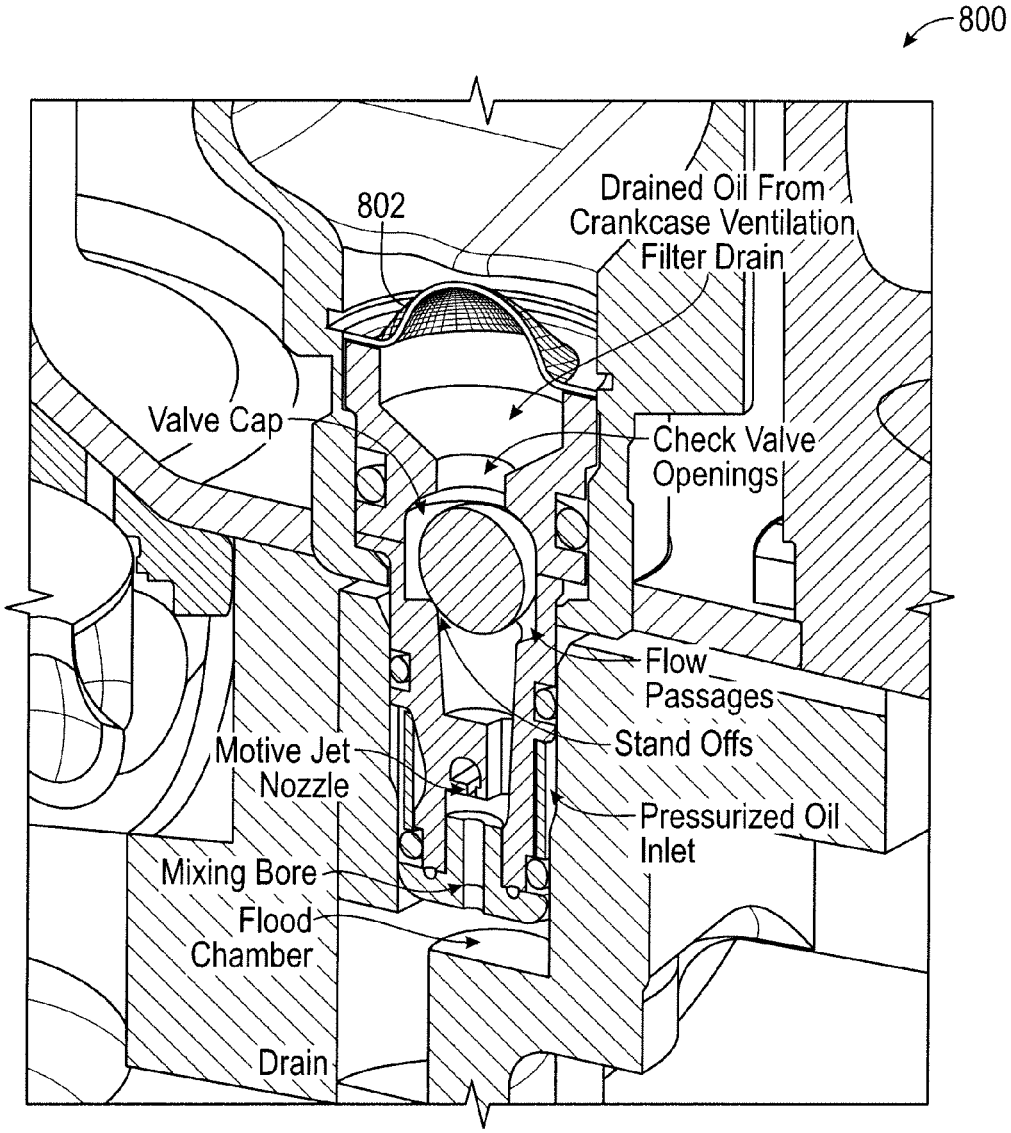
FIG. 8 is a cross-sectional view of a check valve of a CV system shown according to an exemplary embodiment

Referring to FIG. 8, a cross-sectional view of a check valve of a CV system 800 shown according to an exemplary embodiment. The check valve of FIG. 8 is similar to the check valve shown in FIG. 5 and FIG. 6. As shown in FIG. 8, a protective screen 802 is positioned over the check valve opening.

The above described check valve and oil pump combinations for use with CV systems may be used with stationary and dynamic crankcase ventilation filters. The check valve may be integrated with the pump component or may be separate components attached with fasteners.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A crankcase ventilation system comprising:

a crankcase ventilation filter configured to vent blow-by gases from a crankcase;

a crankcase ventilation filter drain coupled to the crankcase ventilation filter, wherein the crankcase ventilation filter drain is configured to collect oil that enters the crankcase ventilation filter and to return the collected oil to the crankcase;

a pressurized oil supply;

a nozzle coupled to the pressurized oil supply and configured to form an oil jet adjacent to an exit of the crankcase ventilation filter drain; and a valve coupled to the crankcase ventilation filter drain, wherein the valve is configured to prevent collected oil from entering the crankcase ventilation filter through an opening that connects the crankcase ventilation filter drain to the crankcase ventilation filter;

wherein when a temperature of the pressurized oil is above a threshold temperature, the oil jet draws the collected oil out of the exit, and wherein when the temperature of the pressurized oil is below the threshold temperature, the oil jet does not draw the collected oil out of the crankcase ventilation filter drain, and oil from the pressurized oil supply backtracks into the crankcase ventilation filter drain.

2. The crankcase ventilation system of claim 1, wherein the valve includes a ball having density less than the oil such that when a threshold amount of oil collects in the crankcase ventilation filter, the ball is forced against the opening, thereby preventing the collected oil from entering the crankcase ventilation filter through the opening.

3. The crankcase ventilation system of claim 2, wherein the opening is chamfered or domed so as to prevent the ball from sticking in the opening.

4. The crankcase ventilation system of claim 2, wherein the valve includes a standoff that supports the ball when the ball is not blocking the opening such that the ball does not block the crankcase ventilation filter drain.

5. The crankcase ventilation system of claim 4, wherein the standoff is a support platform, a rib, a machined pocket, or a cavity.

6. The crankcase ventilation system of claim 1, wherein the valve includes a disc configured to press against the opening and prevent the collected oil from entering the crankcase ventilation filter through the opening.

7. The crankcase ventilation system of claim 6, wherein the disc has a density less than the oil such that the oil forces the disc against the opening.

8. The crankcase ventilation system of claim 6, wherein the crankcase ventilation filter drain includes guides that guide the movement of the disc such that the disc is prevented from sticking against the opening.

9. The crankcase ventilation system of claim 1, wherein the crankcase ventilation filter is an inertial separator, a static coalescer, or a dynamic coalescer.

10. The crankcase ventilation system of claim 1, wherein a diameter of the crankcase ventilation filter drain is at least three times a diameter of the nozzle.

11. The crankcase ventilation system of claim 1, wherein oil in the crankcase ventilation filter drain is at a lower pressure than oil downstream of the crankcase ventilation filter drain.

12. The crankcase ventilation system of claim 1, further comprising a screen positioned between the valve and the crankcase ventilation filter.

13. A lubrication system for an internal combustion engine having a crankcase, the lubrication system including:

a crankcase ventilation filter drain configured to provide separated oil from crankcase blow-by gases, the separated oil being at a lower pressure than oil in the internal combustion engine;

a mixing bore in fluid communication with the crankcase ventilation filter drain;

a pressurized oil supply;

a nozzle in fluid communication with the pressurized oil supply and configured to direct a pressurized flow of oil into the mixing bore such that the pressurized flow of oil draws the separated oil from the crankcase ventilation filter drain into a component of the internal combustion engine; and a valve coupled to the crankcase ventilation filter drain, the valve configured to prevent the separated oil from flowing back into the crankcase.

14. The lubrication system of claim 13, wherein the valve includes a ball having density less than the oil such that when a threshold amount of the separated oil collects in the crankcase ventilation filter drain, the ball is forced against an opening between the crankcase ventilation filter drain and a crankcase ventilation filter, thereby preventing the separated oil from entering the crankcase ventilation filter through the opening.

15. The lubrication system of claim 14, wherein the opening is chamfered or domed so as to prevent the ball from sticking in the opening.

16. The lubrication system of claim 14, wherein the valve includes a standoff that supports the ball when the ball is not blocking the opening such that the ball does not block the crankcase ventilation filter drain.

17. The lubrication system of claim 13, wherein the valve includes a disc configured to press against an opening between the crankcase ventilation filter drain and a crankcase ventilation filter thereby preventing the separated oil from entering the crankcase ventilation filter through the opening.

18. The lubrication system of claim 17, wherein the standoff is a support platform, a rib, a machined pocket, or a cavity.

19. The lubrication system of claim 17, wherein the disc has a density less than the oil such that the oil forces the disc against the opening.

20. The lubrication system of claim 17, wherein the crankcase ventilation filter drain includes guides that guide the movement of the disc such that the disc is prevented from sticking against the opening.

21. The lubrication system of claim 13, further comprising a crankcase ventilation filter configured to separate oil from the crankcase blow-by gases.

22. The lubrication system of claim 21, wherein the crankcase ventilation filter is an inertial separator, a static coalescer, or a dynamic coalescer.

23. The lubrication system of claim 21, further comprising a screen positioned between the valve and the crankcase ventilation filter.

24. The lubrication system of claim 13, wherein a diameter of the crankcase ventilation filter drain is at least three times a diameter of the nozzle.

* * * * *